US007370891B1

(12) United States Patent
Schmitt et al.

(10) Patent No.: US 7,370,891 B1
(45) Date of Patent: May 13, 2008

(54) LATCHING MECHANISM WITH TRIGGER ACTUATOR

(76) Inventors: David A. Schmitt, 2595 Hackberry Dr., Hastings, MN (US) 55033; Jon E. Leikvold, 13380 Finlay Ave., Apple Valley, MN (US) 55124; Brett Johnson, 2322 Auerbach St., Roseville, MN (US) 55113

( * ) Notice: Subject to any disclaimer, the term of this patent is extended or adjusted under 35 U.S.C. 154(b) by 0 days.

(21) Appl. No.: 11/562,619

(22) Filed: Nov. 22, 2006

(51) Int. Cl.
*E05C 5/00* (2006.01)
*E05C 19/10* (2006.01)

(52) U.S. Cl. ..... 292/113; 292/95; 292/247

(58) Field of Classification Search ..... 292/247, 292/256.69, DIG. 49, 95, 113, 116; 220/324, 220/4.22, 4.23, 4.24, 314; 70/73
See application file for complete search history.

(56) References Cited

U.S. PATENT DOCUMENTS

| | | | | | |
|---|---|---|---|---|---|
| 1,891,217 | A | * | 12/1932 | Komenak | 70/73 |
| 3,051,520 | A | * | 8/1962 | Poe | 292/223 |
| 3,145,038 | A | * | 8/1964 | Swanson | 292/113 |
| 3,394,955 | A | * | 7/1968 | Martin | 292/113 |
| 3,519,298 | A | * | 7/1970 | Gley et al. | 292/113 |
| 3,602,723 | A | * | 8/1971 | Swanson | 292/113 |
| 3,936,082 | A | * | 2/1976 | Swanson | 292/113 |
| 4,358,150 | A | | 11/1982 | Nash | |
| 4,502,715 | A | * | 3/1985 | Lundblade | 292/78 |
| 4,548,435 | A | | 10/1985 | Bourne | |
| 4,782,673 | A | * | 11/1988 | Castelli et al. | 70/72 |
| 4,858,970 | A | | 8/1989 | Tedesco et al. | |
| 4,991,885 | A | | 2/1991 | Poe | |
| 5,024,471 | A | * | 6/1991 | Kahl et al. | 292/97 |
| 5,060,492 | A | * | 10/1991 | Carpenter et al. | 70/73 |
| 5,216,905 | A | * | 6/1993 | Sersch et al. | 70/73 |
| 5,351,509 | A | * | 10/1994 | Visenzi | 70/73 |
| 5,461,892 | A | * | 10/1995 | Hsieh | 70/73 |
| 5,638,709 | A | | 6/1997 | Clavin | |
| 5,924,533 | A | * | 7/1999 | Cnockaert et al. | 190/18 A |
| D413,302 | S | * | 8/1999 | Sekiguchi et al. | D13/133 |
| 6,203,075 | B1 | * | 3/2001 | Wells et al. | 292/113 |
| 6,527,309 | B1 | * | 3/2003 | Gaydos et al. | 292/128 |
| D483,430 | S | | 12/2003 | Teskey | |
| 6,845,640 | B2 | | 1/2005 | Loeff et al. | |
| 6,851,289 | B2 | | 2/2005 | Ramsauer | |
| 6,955,381 | B2 | | 10/2005 | Parker et al. | |
| 7,008,289 | B2 | | 3/2006 | Norman | |
| 2002/0162841 | A1 | * | 11/2002 | Shamir et al. | 220/326 |
| 2004/0178202 | A1 | * | 9/2004 | Serio | 220/324 |
| 2006/0042897 | A1 | * | 3/2006 | Sanderson | 190/120 |

* cited by examiner

*Primary Examiner*—Patricia Engle
*Assistant Examiner*—Alyson M Merlino
(74) *Attorney, Agent, or Firm*—Haugen Law Firm PLLP; Frederick W. Niebuhr

(57) ABSTRACT

A latching mechanism for a carrying case includes a latch body pivotally attached to a top cover of the case, a trigger pivotally attached to the latch body, and an actuator that pivots about the same axis as the trigger. The trigger is pivotable between a latching position for keeping the latch body closed, and a release position to allow the case to be opened. The actuator is pivotable toward and away from a nominal actuator position in which a panel of the actuator assumes a predetermined alignment with the latch body. A torsion spring biases the trigger toward the latching position, and through trigger/actuator contact biases the actuator into the nominal position. The trigger can move toward the release position while the actuator is held in the nominal position, to maintain the selected alignment for a more natural, intuitive latching mechanism closure.

30 Claims, 6 Drawing Sheets

LATCHING MECHANISM WITH TRIGGER ACTUATOR

BACKGROUND OF THE INVENTION

The present invention relates to container latching mechanisms, and more particularly to latching mechanisms with triggers operable alternatively to securely maintain latch closure, and to quickly and conveniently release a latch.

Latching mechanisms are used to provide releasable closure to a wide variety of items including doors, windows, vehicle doors and tailgates, and containers of all types. Of most interest to the present invention are latches, typically of the single throw type, used to releasably close luggage, transport cases and carrying cases. Such latching mechanisms typically include a primary latch body pivotally mounted to one section of the case, e.g. the lid, to pivot into and out of container closing position in which the latch body engages a lip, flange or other coupling feature of a second section of the case. Such cases often are required to provide tight closure, even waterproof closure in some instances, yet are opened and closed frequently during normal usage, so that simple and intuitive opening and closing of the latches is of primary importance.

To this end, latching mechanisms often include a latch trigger or other feature mounted to the primary latch body, to assist in maintaining the latching body closed securely when desired, and operable by hand to effect a quick and convenient release of the latch body for opening the case. For example, U.S. Pat. No. 6,955,381 (Parker et al.) discloses a double throw latching mechanism including a first elongated body pivotally mounted to a case and including a hook element for engaging a mating formation on another part of the case. A second elongated body is pivotally mounted to the first, to bear against the case and force the hook element out a closure position.

U.S. Pat. No. 6,527,309 (Gaydos et al.) is directed to a latching apparatus in which a release button is pivotally mounted to a latch, which in turn is pivotally mounted to the top half of a container while a bottom portion of the latch can engage a lower half of the container to maintain closure. The release button includes a locking arm, and is spring biased to keep the locking arm engaged with a boss of the container lower half. Pressing the release button pivots the locking arm away from the boss.

A U.S. application (Sanderson, Publication No. US 2006/0042897) concerns a trigger latch assembly including a latch cover pivotally mounted to the cover of a transport case. A latch trigger is mounted pivotally to the latch cover, and includes an engagement member positioned to engage the bottom portion of the transport case. The latch trigger is spring biased into a closed position, but is rotatable against the spring force to release the latch.

Although suitable for their intended purposes, the foregoing latching mechanisms have their shortcomings. The double throw mechanism in Parker is unduly complex, although it provides a mechanical advantage for a latch opening. The Gaydos device requires counter-intuitive simultaneous pushing of a button toward the case while pulling the latch away from the case. The Sanderson latch requires positioning the thumb and fingers on opposite sides of the latch cover and latch trigger to squeeze these components towards each other, a difficult task for individuals having larger hands or wearing gloves.

Therefore, the present invention is directed to one or more of the following objects:

- to provide a container latching mechanism capable of exerting significant container closure force, yet releasable by pulling a closed latch away from the container;
- to provide a latching mechanism in which container closure is achieved simply by pushing the latch toward the container when the container is closed;
- to provide a latching mechanism with an actuating component selectively operable on a latch trigger to open the latch, while allowing independent movement of the trigger during latch closure; and
- to provide a simpler and more reliable latching device.

SUMMARY OF THE INVENTION

Toward achieving these and other objects, there is provided a container latch assembly. The latch assembly includes a latch body having an outside surface and adapted to be pivotally mounted to a first container section of a container, for movement between an open position and a closed position. A trigger is mounted to the latch body for movement relative to the latch body between a latching position and a release position. The trigger has a coupling element adapted to form a releasable engagement with a coupling feature integral with a second container section responsive to movement of the latch body toward the closed position, to retain the latch body in the closed position to maintain container closure. A biasing component is adapted to urge the trigger toward the latching position to maintain the releasable engagement when the latch body is in the closed position. An actuator is mounted to the latch body for movement toward and away from a nominal actuator position in which an outside surface of the actuator is selectively aligned with the outside surface of the latch body. The actuator has a trigger-contact feature positioned for contact with the trigger whereby the actuator is operable, when moved away from the nominal actuator position during said contact, to move the trigger from the latching position toward the release position against the force of the biasing component. The biasing component is operable through the trigger during said contact, to urge the actuator toward the nominal actuator position. The trigger-contact feature further is adapted to allow movement of the trigger away from the latching position and toward the release position while the actuator is maintained in the nominal actuator position.

Several advantages arise from mounting the trigger and actuator movably relative to the latch body and positioned for contact with one another, yet with the capacity to move independently of one another. When the latch is closed, the biasing means (due to trigger/actuator contact) acts through the trigger to bias the actuator into the nominal actuator position. In this configuration the actuator functions as an integral extension of the trigger. A radially outward portion of the actuator thus is biased into a position that affords maximum ease of gripping the latch to open the case.

The case is opened by moving the actuator away from the nominal actuator position. With the actuator and trigger still in contact, the actuator continues to function as an integral trigger extension, moving the trigger toward the release position against the biasing force.

Thus, the latch can be opened by a simple pulling movement. There is no need to press a button or reach beneath the latch body to squeeze a trigger toward the body.

In contrast, when the open latch is being closed, the trigger and actuator move out of contact with each other. Specifically, as the latch body is pivoted toward the closed position with the actuator in the nominal position, the trigger is movable out of contact with the actuator toward the release position to "clear" the coupling feature, whereupon the trigger returns to the latching position to effect and maintain container closure.

Thus, the user is able to close the latch through a simple, natural pushing movement against the latch body and actuator.

Preferably the trigger and actuator are mounted to pivot relative to the latch body about a common pivot axis. This allows the trigger and actuator to be supported by a common pivot pin mounted to the latch body, with a suitable biasing component being a torsion spring with a coil that surrounds the pivot pin.

The trigger coupling element advantageously comprises a detent with an inclined ramp surface positioned to contact the coupling feature as the latch body is moved toward closure. After contact, the ramp surface causes the trigger to rotate toward the release position responsive to further latch closure.

Another aspect of the present invention is a container. The container includes first and second container sections adapted to be removably coupled to one another in a container closure configuration, and a coupling feature integral with the second container section. A latch body is pivotally coupled to the first container section for movement about a latch body pivot axis, between an open position for allowing entry into the container and a closed position adjacent the second container section for maintaining the first and second container sections in the closure configuration. A trigger is mounted to the latch body for movement relative to the latch body between a latching position and a release position. The trigger includes a coupling element adapted to form a releasable engagement with the coupling feature responsive to movement of the latch body into the closed position, thereby to retain the latch body in the closed position. A biasing component is adapted to urge the trigger toward the latching position to maintain the releasable engagement when the latch body is in the closed position. An actuator is mounted to the latch body for movement toward and away from a nominal actuator position relative to the latch body. The actuator has a trigger-contact feature positioned for contact with the trigger whereby the actuator is operable, when moved away from the nominal actuator position during said contact, to move the trigger from the latching position toward the release position against the force of the biasing component. The biasing component is adapted to urge the trigger into contact with the trigger-contact feature of the actuator, and to act through the trigger during said contact to urge the actuator toward the nominal actuator position.

In a preferred version of the case, two generally rectangular case sections are coupled pivotally through a hinge arrangement along one side of a case, and a pair of latches are mounted along the opposite side. In each of the latches, the latch body has a container contact feature adapted to engage the lip or other coupling feature of the case. The contact features are selectively inclined to provide tighter container closure as their associated latches are moved into the closed position. This ensures that the latch bodies, rather than the triggers or actuators, bear the force required to maintain a secure closure.

Thus, in accordance with the present invention, a container latch is configured to afford a secure, reliable container closure, yet to allow convenient opening and closing of the latch, in each case through a simple and intuitive movement. At the same time, the latch is configured to reliably maintain container closure to prevent accidental release in the event the container is dropped, jostled, or otherwise subject to external forces. Configuration of the trigger and actuator for contact with one another to function as a unit, and alternatively to disengage for independent movement, provides a unique and desired tactile sense to the user when opening and closing the latch.

BRIEF DESCRIPTION OF THE DRAWINGS

For a further understanding of the above and other features and advantages, reference is made to the following detailed description and to the drawings, in which.

DETAILED DESCRIPTION OF THE PREFERRED EMBODIMENTS

Figure 1:
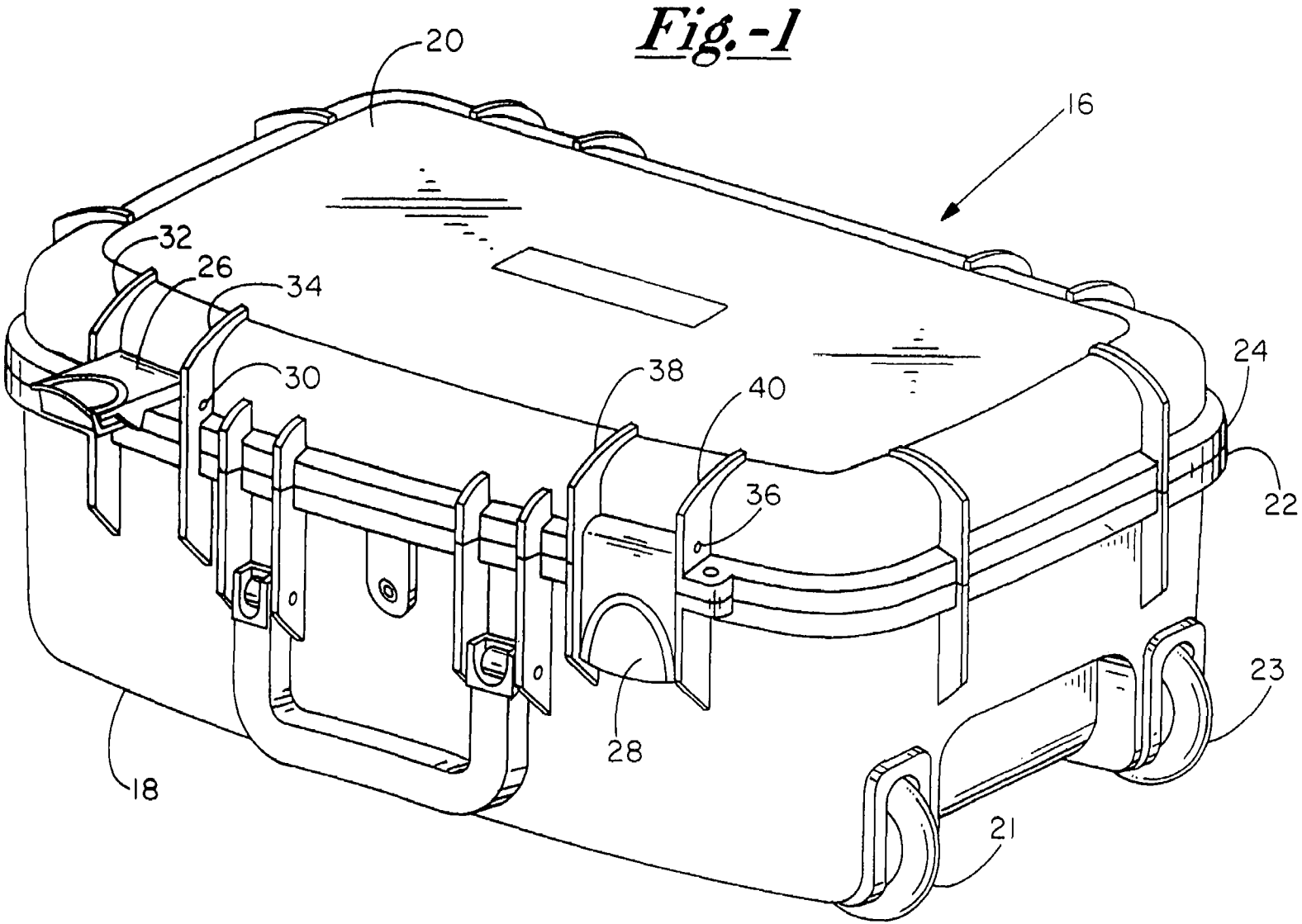
FIG. 1 is a perspective view of a carrying case incorporating a latching system configured according to the present invention.

Turning now to the drawings, there is shown in FIG. 1 a carrying case 16 equipped with a latching system configured in accordance with the present invention. The case includes a generally rectangular bottom section 18 and a top section or cover 20 mounted pivotally to the bottom section through a hinge arrangement, not shown. Bottom section 18 and cover 20 have respective rims 22 and 24 that are maintained in contiguous surface engagement when case 16 is closed. Wheels 21 and 23 provide for convenient transport of the case.

A pair of latching mechanisms, indicated at 26 and 28, are pivotally attached to top cover 20 along the side thereof opposite the hinge arrangement. Latching mechanism 28 is shown in the closed position suitable for maintaining rims 22 and 24 engaged, to effect and maintain container closure. Latching mechanism 26 is shown in the open position remote from the rims to permit access to the case interior.

Latching mechanism 26 is mounted to cover 20 through a latch support pin 30 anchored to an opposed pair of cover bosses 32 and 34. Similarly, latching mechanism 28 is mounted to the top cover through a latch support pin 36 and cover bosses 38 and 40 integral with the top cover.

Figure 2:
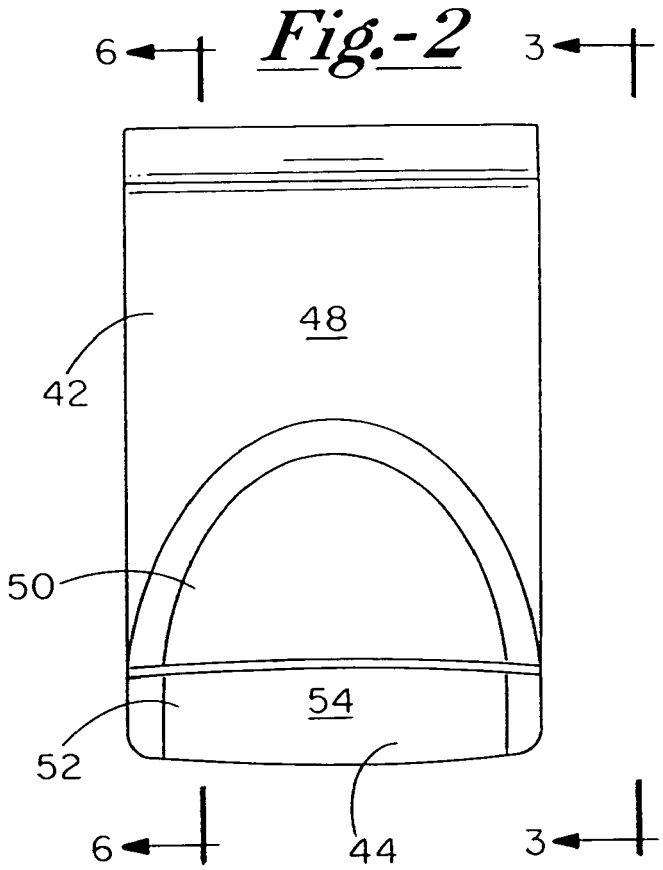
FIG. 2 is a frontal elevation showing one of the latching mechanisms of the latching system.
Figure 3:
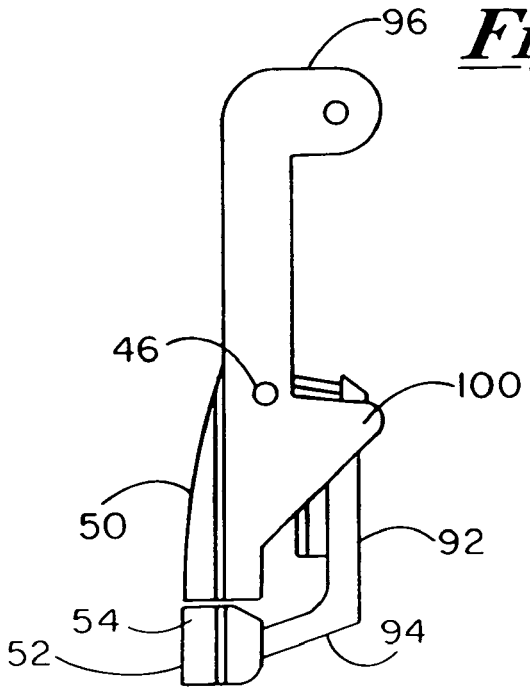
FIG. 3 is a side elevation showing the latch of FIG. 2.

As seen in FIGS. 2 and 3, latching mechanism 26 includes a latch body 42 and an actuator 44. With particular reference to FIG. 3, the actuator is mounted to pivot relative to the latch body through a pivot pin 46. With respect to latch body 42, actuator 44 tends to occupy the position shown, whether the latching mechanism is open or is closed. For this reason, the position illustrated is conveniently thought of as the nominal actuator position. As explained below, the actuator is movable away from the nominal position, clockwise as viewed in FIG. 3, to release the latching mechanism when opening the case.

Latch body 42 has an outside surface 48 that is substantially planar in the upper region of the latch body, while forming a curved, outwardly directed relief 50 in the lower region of the latch body. Actuator 44 includes a panel 52 shaped to provide an outside surface 54 convex in the outward direction. When actuator 44 is in the nominal actuator position, outside surfaces 48 and 54 are aligned to be substantially flush, and cooperate to provide a single relief for convenient pushing of the latch body and actuator simultaneously to close the latching mechanism.

Figure 5:
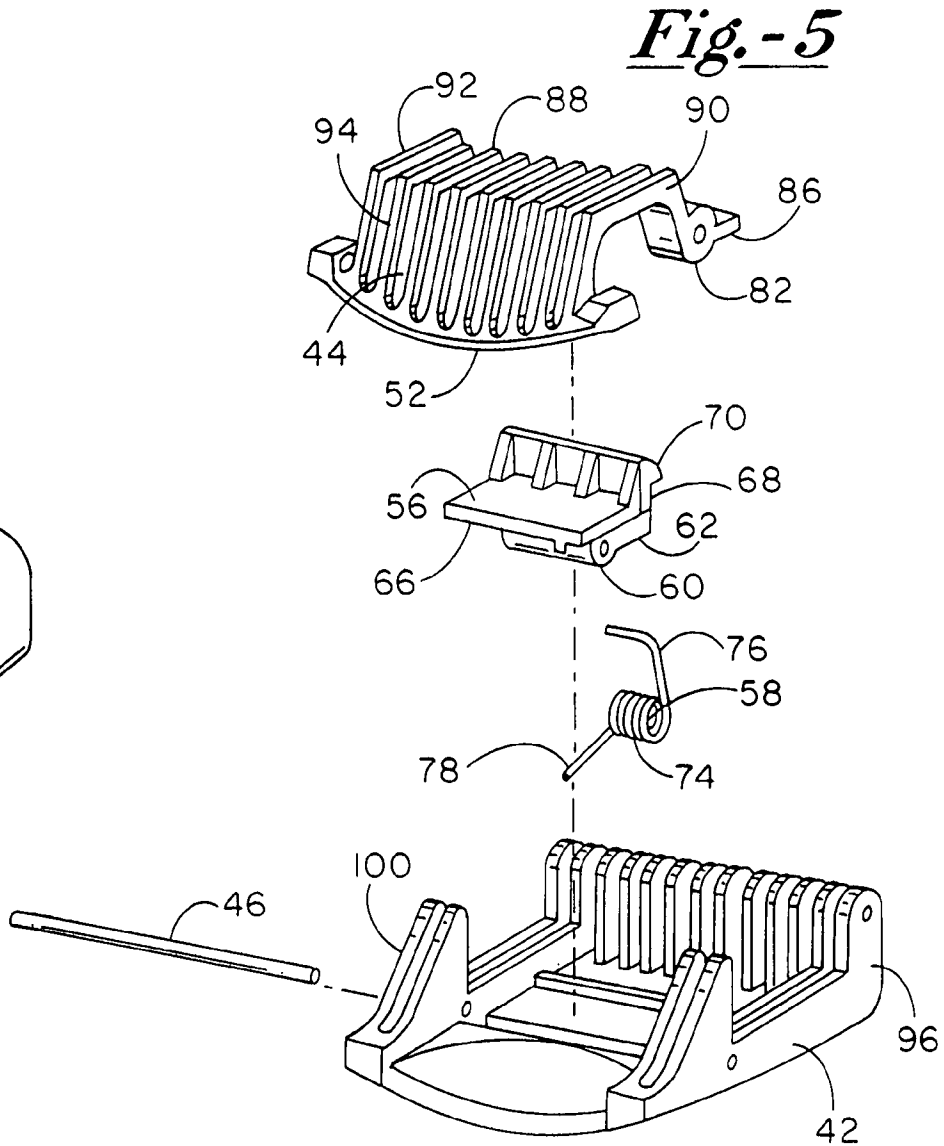
FIG. 5 is a perspective exploded-parts view of the latching mechanism.
Figure 4:
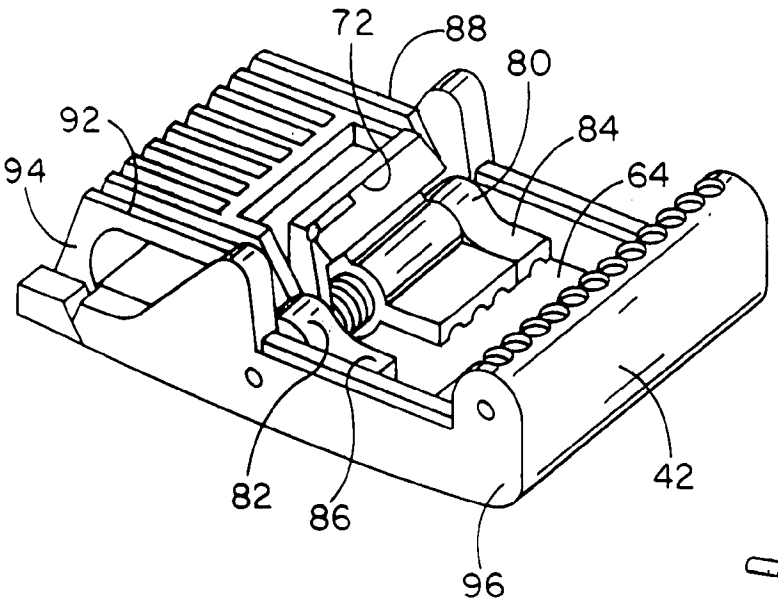
FIG. 4 is a perspective view of the latching mechanism.

As best seen in FIGS. 4 and 5, latching mechanism 26 further includes a trigger 56 and a torsion spring 58. The trigger is mounted on pivot pin 46, to pivot relative to latch body 26 about the same pivot axis as the actuator. Trigger 56 includes a central mounting region 60 that forms an opening sized to accommodate pin 46. A latch panel 62 extends as a cantilever away from the mounting region. Panel 62 is positionable against an inside surface 64 of latch body 42 as shown in FIG. 4, to limit rotation of the trigger relative to the latch body. Torsion spring 58 biases the trigger into the position shown, with the engagement of panel 62 with surface 64 preventing further trigger movement in response to the spring.

Trigger 56 further includes an actuator contact panel 66 extending in cantilever fashion away from mounting region 60. Panel 66 is positioned to engage actuator 44, and when in contact with the actuator, to prevent the trigger from rotating relative to the actuator in the counter-clockwise direction as viewed in FIG. 3.

A coupling member 68 extends away from mounting region 60 and has at its free end a coupling element 70 designed to engage a coupling feature integral with bottom section 18 of the case, thus to maintain latch body 26 in the closed position for maintaining container closure. Coupling element 70 is shaped to provide an inclined ramp surface 72 positioned to encounter the coupling feature during latch closure, as is later explained.

Torsion spring 58 includes a coil 74 that surrounds pivot pin 46, a first end 76 positioned to bear against trigger 56, and a second end 78 position to bear against latch body 42, thus to bias trigger 56 to rotate relative to the latch body counter-clockwise as viewed in FIG. 3.

Actuator 44 has a pair of actuator extensions, as indicated at 80 and 82. Each extension includes a body portion with an opening therethrough to accommodate pin 46, to provide pivotal support for the actuator. The extensions further include respective detents 84 and 86 positioned to contact surface 64 of the latch body as shown in FIG. 4, to limit actuator rotation relative to the latch body in the counter-clockwise direction as viewed in FIG. 3.

Arms 88 and 90 extend from the respective body portions to support the remainder of actuator 44, including a trigger contact region 92, a panel support region 94 extending outwardly from the free end of the trigger contact region, and panel 44 which is supported at the outer end of the panel support region.

Contact region 92 of the actuator is positioned to contact panel 66 of trigger 56 and, when contacting the panel, to prevent actuator 44 from rotating relative to trigger 56 in the clockwise direction as viewed in FIG. 3.

Figure 6:
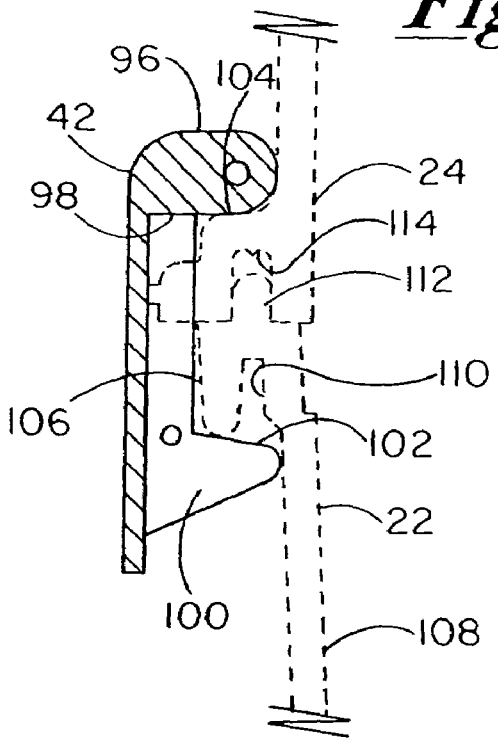
FIG. 6 is a sectional view taken along the line 6-6 in FIG. 2.

As seen from FIG. 6, closure of case 16 is maintained by a clamping action of the latch body, acting in concert with the hinge arrangement. An upper region 96 of latch body 42 includes a bottom edge 98 positioned near rim 24 when the latching mechanism is closed. A clamping member 100 of the latch body is shaped to provide a contact surface 102 which is approximately horizontal, but slightly inclined downwardly and to the right as viewed in FIG. 6.

Rim 24 of the top cover includes an upper surface 104 positioned proximate edge 98 of the latch body. Rim 22 of the bottom section includes a downwardly extending lip or flange 106, spaced apart for horizontally from a forward wall 108 of section 18 to form a gap 110. Rim 22 further includes an elongate, upwardly extending rib 112 positioned for entry into an elongate channel 114 formed in rim 24 to form an engagement of rims 22 and 24. Preferably an o-ring (not shown) in channel 114 is compressed by rib 112 to provide a substantially water tight seal.

Establishing and maintaining a secure closure can require considerable clamping force, primarily in the vertical direction as viewed in the figure. To this end, surface 102 of clamping member 100 is disposed to contact flange 106 before latch body 42 reaches the closed position. After contact, continued counter-clockwise pivoting of the latch body causes clamping member 100 to urge flange 106 and rim 22 upwardly into a tighter, more secure engagement against rim 24. Trigger 56, while not contributing to the clamping action just described, facilitates the clamping action by engaging flange 106 to prevent latch body 42 from pivoting clockwise until the trigger is released.

Latching mechanism 28 is not described in detail, but is substantially identical to latching mechanism 26.

Figure 7:
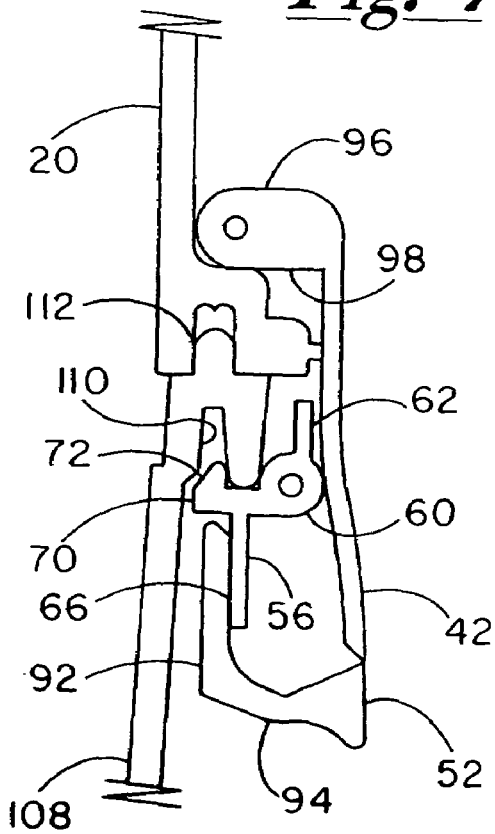
FIGS. 7-10 are schematic views illustrating features of the latching mechanism during opening and closing of the case.

The operation of latch 26 can be understood with reference to FIGS. 7-10. FIG. 7 illustrates the trigger latching action, with coupling element 70 extending into gap 110 while engaged with the flange, thus to keep latch body 42 in the closed position. Ends 78 and 76 of the torsion spring bear against latch body 42 and trigger 56 respectively, urging the trigger in the clockwise rotational direction as viewed in FIG. 7. This maintains the engagement of coupling element 70 with flange 106, and further urges panel 66 of the trigger against contact region 92 of the actuator, which in turn drives actuator detents 84 and 86 against the latch body to maintain actuator 44 in the nominal actuator position.

Figure 8:
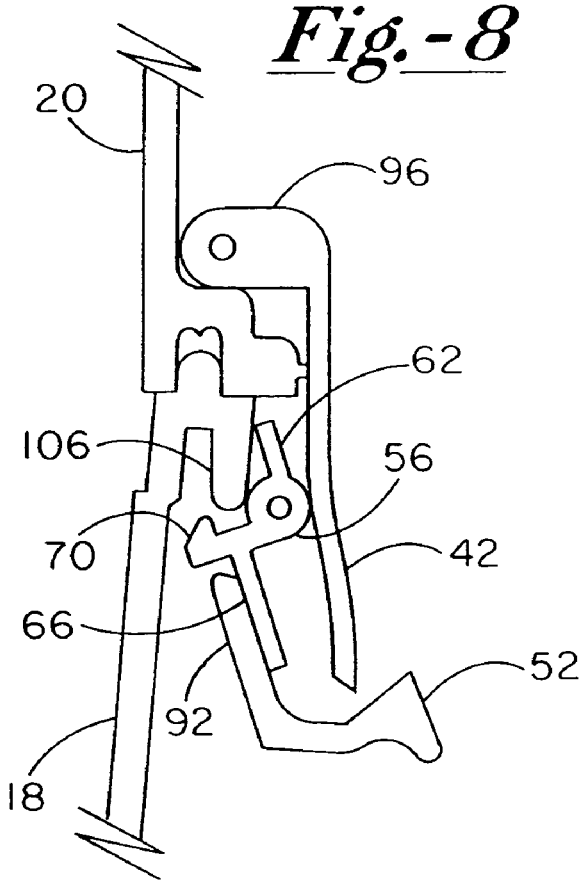

To open case 16, the user places his or her fingers against panel support region 94 of the actuator, and with a simultaneous pulling and lifting action, pivots the actuator counter-clockwise against the force of spring 58. Due to the contact between panel 66 and region 92, this also pivots the trigger counter-clockwise to release the latch by freeing coupling element 70 from flange 106 as seen in FIG. 8.

Figure 9:
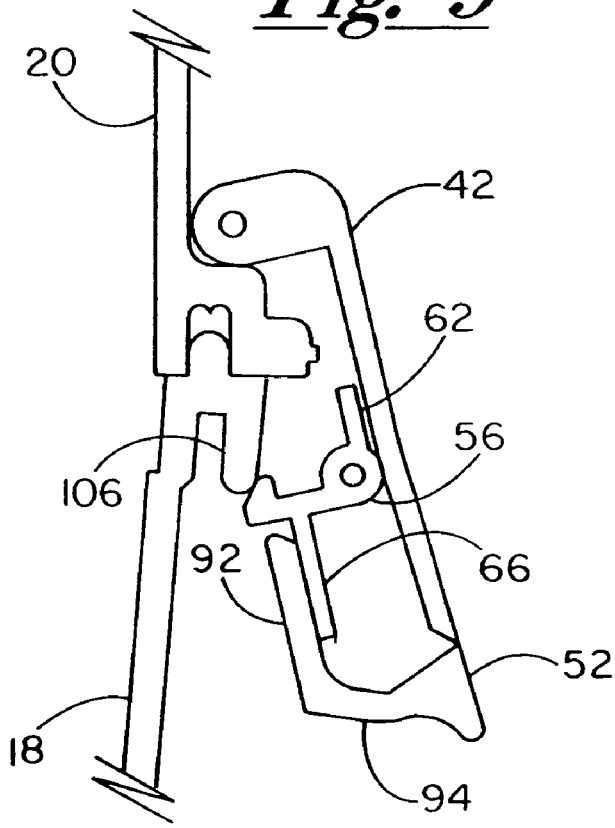
Figure 10:
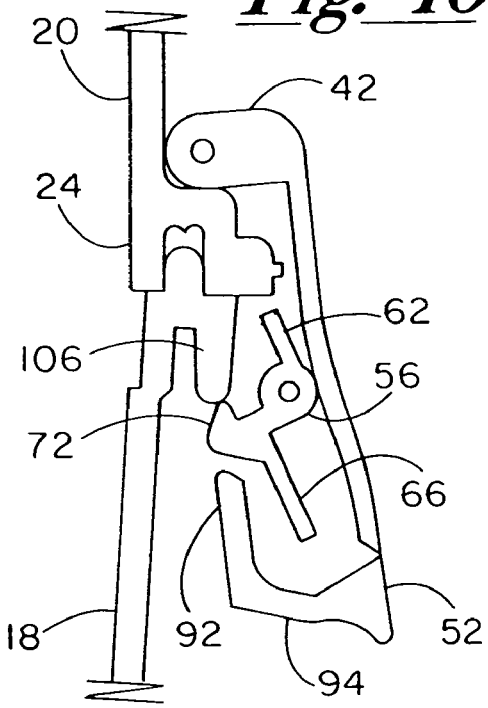

Continued pulling of the actuator in this direction eventually causes latch body 42 to pivot counter-clockwise relative to the case, carrying trigger 56 with it until the trigger is free of flange 106. This causes the trigger to return to the latching position under the influence of torsion spring 58, simultaneously urging actuator 44 back to the nominal actuator position. This result is shown in FIG. 9. At this point, case 16 may be opened.

A significant advantage of latching mechanism 26 resides in the shape of actuator 44, particularly along panel support region 94. As seen in FIG. 7, the support region extends from a point near forward wall 108 outward to panel 52 which is flush with the free end of the latch body. Support region 94 thus provides a relatively large finger contact area for a user attempting to open the case. There is no need to insert one or more fingers between the actuator and case, and then "squeeze" the actuator and latch body closer together. In fact, the proximity of the inner edge of the support region to the case tends to discourage finger insertion. As a result, latching mechanism 26 as compared to previous designs is much easier to open, particularly for an operator wearing gloves or holding a pencil or other object in his or her hand.

The mounting of trigger 56 and actuator 44 also provides a significant advantage when the latching mechanism is being closed. As perhaps best understood from FIG. 10, trigger 56 is capable of moving from the latching position towards the release position while actuator 44 remains in the nominal actuator position. If the trigger and actuator instead were integrally coupled, movement of the trigger away from the latching position would move the actuator away from the nominal position, e.g. to the position shown in FIG. 8.

As compared to an integral coupling, the independent trigger action affords two advantages. First, it enables the user to close the latching mechanism by pushing against panel 52 to the left or clockwise as viewed in FIG. 10. Latch body 42 moves along with the actuator, due to the action of detents 84 and 86 against the latch body. This type of closure would be impossible if the trigger and actuator were integrally coupled or provided as a single unit.

Second, this arrangement allows users to apply finger pressure simultaneously to latch body 42 and panel 52, again in the leftward or clockwise direction. The latch body and actuator function as a single unit during this type of closure, again due to the action of the detents against the latch body.

Of course, latching mechanism 28 functions in the same manner.

Figure 11:
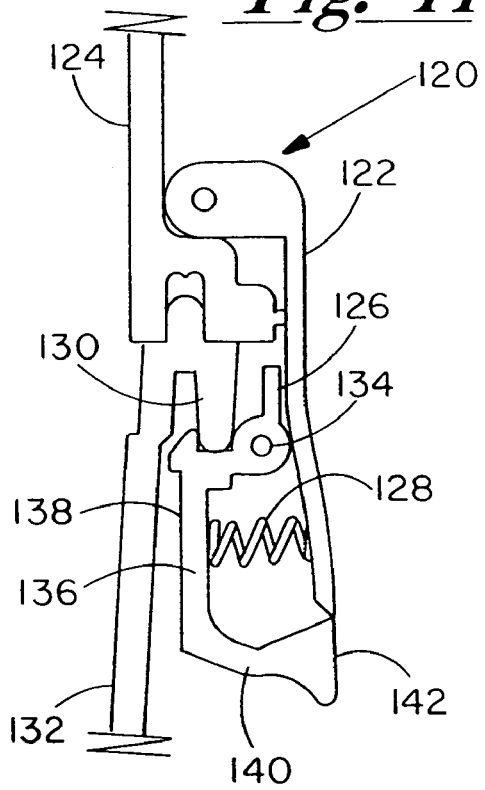
FIGS. 11 and 12 are schematic views showing an alternative embodiment latching mechanism closed, and during closure, respectively.

FIG. 11 is a schematic view of an alternative latching mechanism 120 including a latch body 122 pivotally coupled to a top cover 124 of a case, a triggering device 126 mounted pivotally to the latch body, and a spring 128 biasing the triggering device into a latching engagement with a flange 130 of a bottom section 132 of the case. In this embodiment, the spring does not surround a pivot pin 134, but instead is maintained under compression between the latch body and a contact region 136 of the triggering device.

A further difference is that triggering device 126 incorporates an extension 138 shaped similarly to actuator 44 but formed as in integral part of the triggering device.

Latching mechanism 120 can be opened in essentially the same manner is latching mechanism 26, by an upper and outward pulling of a panel support region 140 that carries a panel 142. Once the triggering device is cleared of flange 130, it tends to return to the latching position under the influence of spring 128.

Accordingly, views of latching mechanism 120 during opening, and upon complete opening, would resemble FIGS. 8 and 9 respectively.

Figure 12:
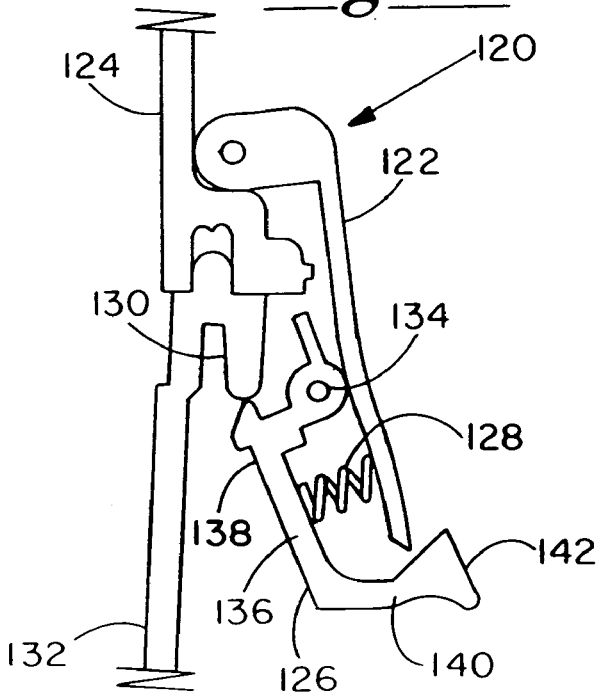

In contrast, latching mechanism 120 is not closed in the same manner as latching mechanism 26 because extension 138 is an integral part of the triggering device. Rotation of the triggering device toward the release position carries actuator extension 138 and panel 142 counter-clockwise relative to the latch body, so that the configuration during closure is as shown in FIG. 12. Thus, latching mechanism 120 can be closed by applying finger pressure to the lower portion of latch body 122 and preferably near the bottom, but it cannot be closed by applying pressure simultaneously to the latch body and panel 142, or by applying pressure exclusively to panel 142.

Accordingly, while latching mechanism 120 is made according to a simpler design involving fewer moving parts, latching mechanism 26 is generally preferred.

Thus, in accordance with the present invention, a latching mechanism is adapted to provide secure closure of a traveling case or other container, while incorporating a trigger that is released to open the mechanism by a single, natural and intuitive movement of the hand and fingers. The latching mechanism incorporates an independently movable actuator, or alternatively an actuator extension of a triggering device, shaped to facilitate latch opening. In particularly preferred embodiments of the invention, the independent actuator is configured to pivot the trigger toward release while the actuator is kept in its nominal position, to facilitate a natural and intuitive closure of the latching mechanism.

What is claimed is:

1. A container latch assembly, including:

a latch body having an outside surface and adapted to be pivotally mounted through a latch body pivot axis to a first container section of a container for movement between an open position and a closed position;

a trigger mounted to the latch body at a location spaced apart from the latch body pivot axis for arcuate travel about the latch body pivot axis as the latch body pivots, the trigger further being mounted for movement relative to the latch body between a latching position and a release position, the trigger having a coupling element adapted to form a releasable engagement with a coupling feature integral with a second container section responsive to movement of the latch body toward the closed position, to retain the latch body in the closed position to maintain container closure;

a biasing component adapted to urge the trigger toward the latching position to maintain said releasable engagement when the latch body is in the closed position; and an actuator mounted to the latch body for movement toward and away from a nominal actuator position in which an outside surface of the actuator is selectively aligned with the outside surface of the latch body, said actuator having a trigger-contact feature positioned for contact with the trigger whereby the actuator is operable, when moved away from the nominal actuator position during said contact, to move the trigger from the latching position toward the release position against the force of the biasing component;

wherein the biasing component is operable through the trigger during said contact, to urge the actuator toward the nominal actuator position; and wherein the trigger-contact feature further is adapted to allow movement of the trigger away from the latching position and toward the release position while the actuator is maintained in the nominal actuator position.

2. The latch assembly of claim 1 wherein:

the latch body has a container contact feature adapted to engage the coupling feature to maintain container closure when so mounted to the first container section.

3. The latch assembly of claim 2 wherein:

the container contact feature is selectively inclined to tighten the container closure as the latch body is moved into the closed position.

4. The latch assembly of claim 1 wherein:

the trigger is pivotally mounted to the latch body about a trigger pivot axis parallel to and spaced apart from the latch body pivot axis.

5. The latch assembly of claim 4 wherein:

the trigger pivot axis is disposed proximate to the coupling feature when the latch body is so mounted and in the closed position.

6. The latch assembly of claim 5 wherein:

the trigger includes a stop positioned to engage the latch body and thereby prevent rotation of the trigger, in the direction away from the release position, beyond the latching position.

7. The latch assembly of claim 1 wherein:

the coupling element is positioned to enter a gap between the second container section and the coupling feature, and to bear against the coupling feature to maintain the latch body in the closed position.

8. The latch assembly of claim 7 wherein:

the coupling element has an inclined surface positioned for a surface engagement with the coupling feature as the latch body when so mounted is pivoted toward the closed position, with further closure of the latch body after said surface engagement moving the trigger toward the release position against the force of the biasing component.

9. The latch assembly of claim 4 wherein:

the actuator is mounted to pivot relative to the latch body about an actuator pivot axis parallel to and spaced apart from the latch body pivot axis.

10. The latch assembly of claim 9 wherein:

the actuator, when in the nominal actuator position and with the latch body so mounted and in the closed position, includes a radially outward region extending in cantilever fashion from a location proximate the second container section to a radially outward end of the latch body.

11. The latch assembly of claim 9 wherein:

the actuator pivot axis coincides with the trigger pivot axis.

12. The latch assembly of claim 9 wherein:

the actuator has an actuator panel disposed radially outward from the actuator pivot axis, and said outside surface of the actuator comprises a panel surface of the actuator panel; and the panel surface is substantially flush with said outside surface of the latch body when the actuator is in the nominal actuator position.

13. The latch assembly of claim 12 wherein:

the actuator includes a stop structure positioned to encounter the latch body and thereby prevent further pivoting of the actuator beyond the nominal position in response to the force of the biasing component.

14. The latch assembly of claim 12 wherein:

the panel cooperates with the latch body to provide a rounded relief including outside surfaces of the panel and latch body.

15. The latch assembly of claim 4 further including:

a pin positionable along the trigger pivot axis for supporting the trigger, wherein the biasing component comprises a torsion spring including a coil surrounding the pin, a first arm extending from the coil in contact with the trigger, and a second arm extending from the coil in contact with the latch body.

16. The combination of the latch assembly of claim 1 and a container comprising first and second container sections movable relative to one another between open and closed positions;

wherein the second container section is pivotally mounted to the first container section.

17. A container including:

first and second container sections adapted to be coupled to one another in a container closure configuration, and a coupling feature integral with the second container section;

a latch body pivotally coupled to the first container section for movement about a latch body pivot axis between an open position for allowing entry into the container and a closed position adjacent the second container section for maintaining the first and second container sections in the closure configuration;

a trigger mounted to the latch body at a location spaced apart from the latch body pivot axis for arcuate travel about the latch body pivot axis as the latch body pivots the trigger further being mounted for movement relative to the latch body between a latching position and a release position, wherein the trigger includes a coupling element adapted to form a releasable engagement with the coupling feature responsive to movement of the latch body into the closed position, thereby to retain the latch body in the closed position;

a biasing component adapted to urge the trigger toward the latching position to maintain said releasable engagement when the latch body is in the closed position; and an actuator mounted to the latch body for movement toward and away from a nominal actuator position relative to the latch body, said actuator having a trigger-contact feature positioned for contact with the trigger whereby the actuator is operable, when moved away from the nominal actuator position during said contact, to move the trigger from the latching position toward the release position against the force of the biasing component;

wherein the biasing component is adapted to urge the trigger into contact with the trigger-contact feature of the actuator, and to act through the trigger during said contact to urge the actuator toward the nominal actuator position.

18. The container of claim 17 wherein:

the trigger-contact feature further is adapted to allow movement of the trigger away from the latching position and toward the release position while the actuator is maintained in the nominal actuator position.

19. The container of claim 17 wherein:

the latch body has a container contact feature adapted to engage the coupling feature to maintain the first and second container sections in the closure configuration.

20. The container of claim 17 wherein:

the trigger is pivotally mounted to the latch body about a trigger pivot axis parallel to and spaced apart from the latch body pivot axis.

21. The container of claim 20 wherein:

the actuator is mounted to pivot relative to the latch body about an actuator pivot axis that coincides with the trigger pivot axis.

22. The container of claim 17 wherein:

the coupling element is positioned to enter a gap between the second container section and the coupling feature to bear against the coupling feature and thereby maintain the latch body in the closed position.

23. The container of claim 22 wherein:

the coupling element has an inclined surface positioned for a surface engagement with the coupling feature as the latch body is pivoted toward the closed position, with further closure of the latch body after said surface engagement moving the trigger toward the release position against the force of the biasing component.

24. The container of claim 17 wherein:

the actuator includes an actuator panel disposed radially outward from the actuator pivot axis, and the actuator panel has an outside surface substantially flush with an outside surface of the latch body when the actuator is in the nominal actuator position.

25. The container of claim 17 wherein:

the coupling feature comprises a lip running along a perimeter of the second container section.

26. The container of claim 17 further including:

a hinge arrangement for pivotally coupling the first and second container sections relative to each other, wherein the latch body is coupled to the first container section along a side thereof opposite the hinge.

27. A container latching mechanism, including:

a latch body adapted to be pivotally mounted through a latch body pivot axis to a first container section of a container for movement between an open position and a closed position;

a trigger mounted to the latch body at a location spaced apart from the latch body pivot axis for arcuate travel about the latch body pivot axis as the latch body pivots, the trigger further being mounted for movement relative to the latch body between a latching position and a release position, the trigger having a coupling element adapted to form a releasable engagement with a coupling feature integral with a second container section responsive to movement of the latch body toward the closed position, to retain the latch body in the closed position to maintain container closure;

a biasing component adapted to urge the trigger toward the latching position to maintain said releasable engagement when the latch body is in the closed position;

an actuating component mounted for movement relative to the latch body toward and away from a nominal position, operable when moved away from the nominal position to move the trigger from the latching position toward the release position against the force of the biasing component;

wherein the actuating component includes a panel supported at a free end thereof and positioned for a predetermined alignment with the latch body when the actuating component is in the nominal position, in which the respective outside surfaces of the latch body and the panel are substantially adjacent and aligned; and wherein the actuating component further includes a panel support region extending in cantilever fashion to the panel from a location proximate a the second container section, when in the nominal position with the latch body in the closed position.

28. The mechanism of claim 27 wherein:

the actuating component is movable relative to the latch body independently of the trigger, includes a trigger-contact feature positioned for contact with the trigger, and is so operable to move the trigger during said contact.

29. The mechanism of claim 28 wherein:

the trigger-contact feature is adapted to allow movement of the trigger away from the latching position and toward the release position while the actuating component is maintained in the nominal position.

30. A container including:

first and second container sections adapted to be removably coupled to one another in a container closure configuration, and a coupling feature integral with the second container section;

a latch body pivotally coupled to the first container section for movement about a latch body pivot axis between an open position for allowing entry into the container and a closed position adjacent the second container section for maintaining the first and second container sections in the closure configuration;

a trigger pivotally mounted to the latch body about a trigger pivot axis parallel to and spaced apart from the latch body pivot axis, for movement relative to the latch body between a latching position and a release position, wherein the trigger includes a coupling element adapted to form a releasable engagement with the coupling feature responsive to movement of the latch body into the closed position, thereby to retain the latch body in the closed position;

a biasing component adapted to urge the trigger toward the latching position to maintain said releasable engagement when the latch body is in the closed position; and an actuator mounted to pivot relative to the latch body about an actuator axis that coincides with the trigger pivot axis, for movement toward and away from a nominal actuator position relative to the latch body, said actuator having a trigger-contact feature positioned for contact with the trigger whereby the actuator is operable, when moved away from the nominal actuator position during said contact, to move the trigger from the latching position toward the release position against the force of the biasing component;

wherein the biasing component is adapted to urge the trigger into contact with the trigger-contact feature of the actuator, and to act through the trigger during said contact to urge the actuator toward the nominal actuator position.

* * * * *